US005669143A

United States Patent [19]

Wu

[11] Patent Number: 5,669,143

[45] Date of Patent: Sep. 23, 1997

[54] EATING UTENSIL WITH HANDLE PROVIDING A VISUAL AMUSING EFFECT

[75] Inventor: Paul Wu, Taipei, Taiwan

[73] Assignees: Dyna Chain Industrial Co., Ltd.; Sara Rose International Inc., both of Taipei Hsien, Taiwan

[21] Appl. No.: 628,052

[22] Filed: Apr. 5, 1996

[51] Int. Cl.[6] ..... A47J 43/28

[52] U.S. Cl. ..... 30/324; 30/322

[58] Field of Search ..... 30/322–328, 125; D7/649, 653, 664

[56] References Cited

U.S. PATENT DOCUMENTS

| | | | |
|---|---|---|---|
| 2,732,187 | 1/1956 | Benedetto | 30/322 |
| 3,259,132 | 7/1966 | Katter | 30/324 |
| 5,264,267 | 11/1993 | Wang | 30/324 X |

*Primary Examiner*—Douglas D. Watts

*Attorney, Agent, or Firm*—Harness, Dickey & Pierce, P.L.C.

[57] ABSTRACT

An eating utensil includes a head unit, a handle unit and a covering. The head unit has a stem with a distal end portion that is formed with a radial flange and an axial insert projection. The handle unit includes a handle body and a plug. The handle body is formed as an elongated hollow transparent body which confines a receiving space for receiving liquid therein and which has a closed end portion and an open end portion. The plug has a first end portion formed with an axial insert hole and a second end portion inserted fittingly into the open end portion of the handle body. The insert projection of the head unit extends fittingly into the insert hole. The covering covers the stem of the head unit, the plug, and the open end portion of the handle body.

4 Claims, 3 Drawing Sheets

EATING UTENSIL WITH HANDLE PROVIDING A VISUAL AMUSING EFFECT

BACKGROUND OF THE INVENTION

1. Field of the Invention

The invention relates to an eating utensil, more particularly to an eating utensil with a handle unit which is capable of providing a visual amusing effect.

2. Description of the Related Art

Conventional eating utensils, such as spoons, forks and knives, normally have head and handle portions that are formed integrally. In a conventional eating utensil, the handle portion is usually engraved to reduce the risk of slipping when the eating utensil is in use and to provide the eating utensil with aesthetic appeal. Eating utensils for children commonly have colorful patterns, such as cartoon characters, printed thereon to attract the interest of a child.

SUMMARY OF THE INVENTION

The object of the present invention is to provide an eating utensil with a handle unit which is capable of providing a visual amusing effect to attract the interest of the user.

Another object of the present invention is to provide an eating utensil with a handle unit which can be used with different head units so as to form different eating utensils, thereby facilitating the fabrication of the different eating utensils.

According to the present invention, an eating utensil includes:

- a head unit having a stem with a distal end portion that is formed with a radial flange and an axial insert projection;
- a handle unit including: a handle body formed as an elongated hollow transparent body which confines a receiving space for receiving liquid therein and which has a closed end portion and an open end portion; at least one float body disposed in the handle body; and a plug having a first end portion formed with an axial insert hole and a second end portion inserted fittingly into the open end portion of the handle body, the insert projection of the head unit extending fittingly into the insert hole; and
- a covering for covering the stem of the head unit, the plug, and the open end portion of the handle body.

Preferably, the covering includes complementary cover parts, each of which has a smooth outer face and an inner face that is formed with a stem receiving groove, a flange receiving groove and a plug engaging groove. The stem of the head unit is disposed in the stem receiving grooves of the cover parts. The radial flange of the head unit is disposed in the flange receiving grooves of the cover parts. The first end portion of the plug has a peripheral section which extends into the plug engaging grooves of the cover parts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
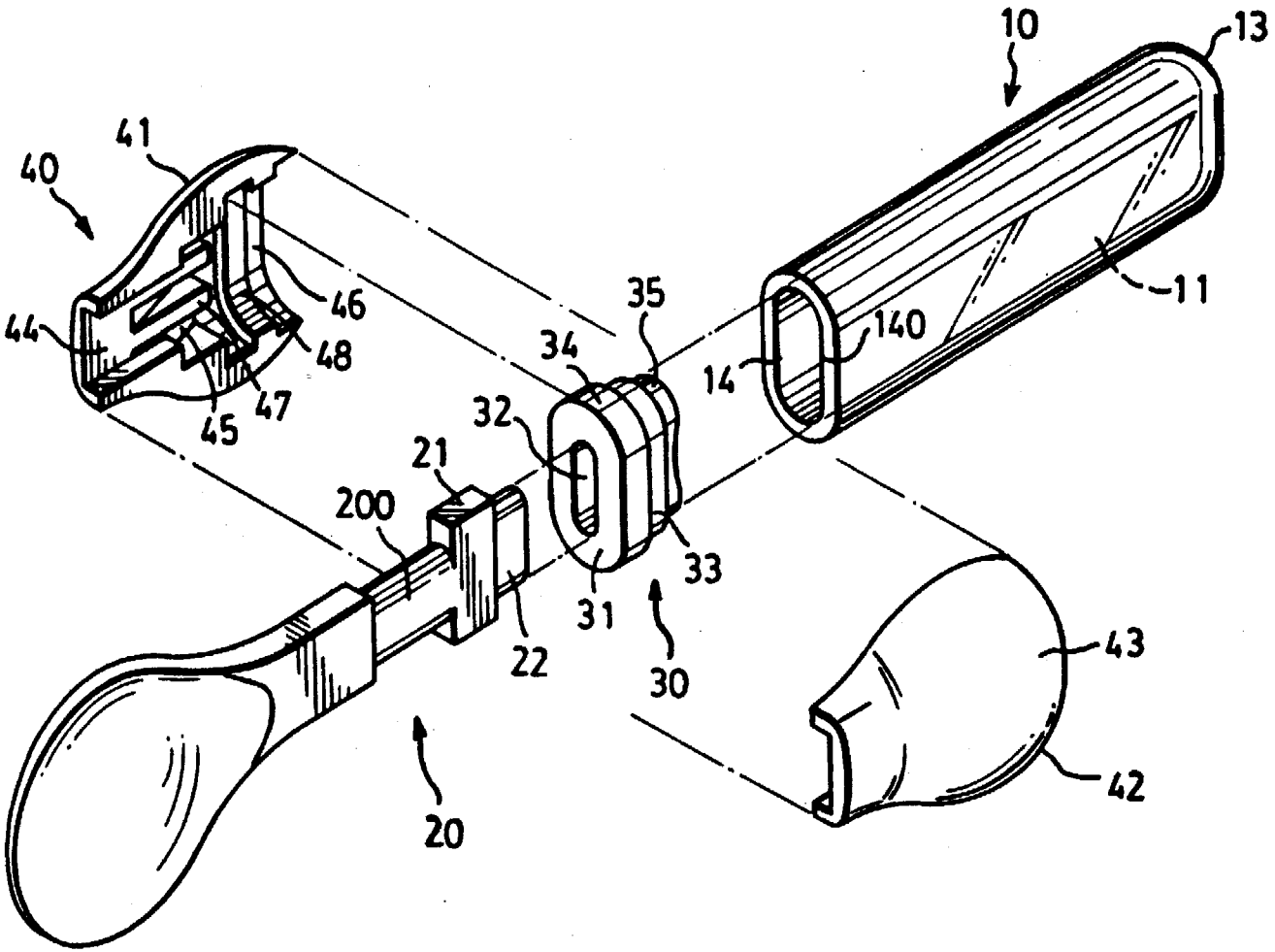
FIG. 1 is an exploded view of the preferred embodiment of an eating utensil according to the present invention.
Figure 2:
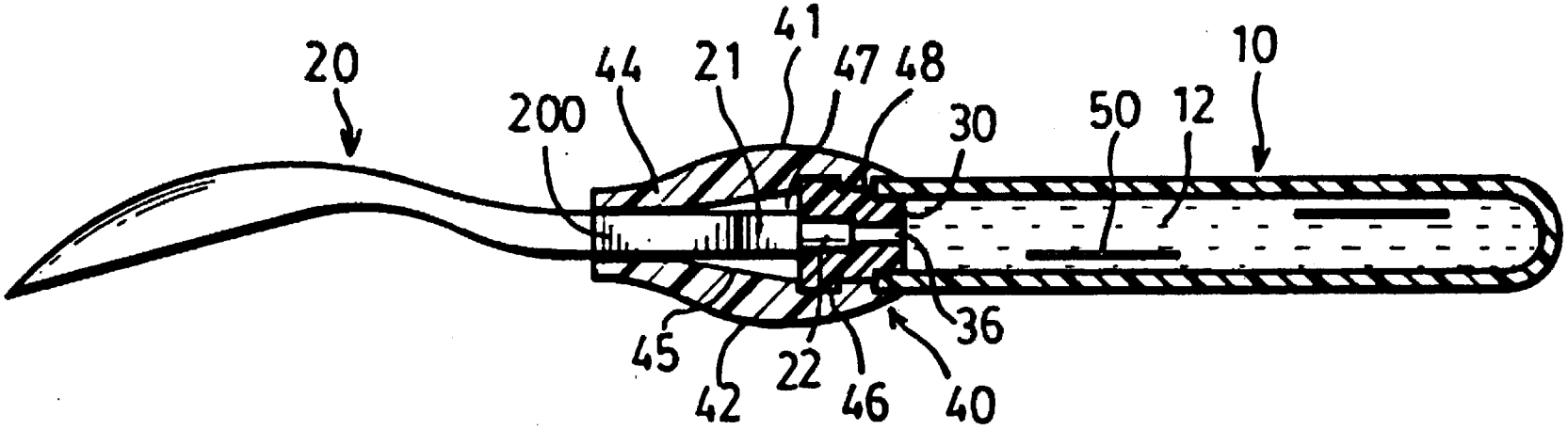
FIG. 2 is a sectional view of the preferred embodiment.

Referring to FIGS. 1 and 2, the preferred embodiment of an eating utensil according to the present invention is shown to comprise a handle unit, a head unit 20 and a covering 40. The handle unit includes a handle body 10 and a plug 30.

The head unit 20 has a stem 200 with a distal end portion that is formed with a radial flange 21 and an axial insert projection 22.

The handle body 10 is formed as an elongated hollow transparent body which confines a receiving space 11 for receiving liquid 12 therein. The handle body 10 has a closed end portion 13 and an open end portion 14.

The plug 30 has a first end portion 34, an intermediate portion 33 which extends axially from the first end portion 34 and which is narrower than the first end portion 34, and a second end portion 35 which extends axially from the intermediate portion 33 and which is narrower than the intermediate portion 33. The first end portion 34 has an end face 31 that is formed with an axial insert hole 32. The second end portion 35 is inserted fittingly into the open end portion 14 of the handle body 10 such that the intermediate portion 33 abuts tightly against an end face 140 of the open end portion 14. The insert projection 22 of the head unit 20 extends fittingly into the insert hole 32 in the first end portion 34 such that the radial flange 21 of the head unit 20 abuts tightly against the end face 31 of the first end portion 34. The head unit 20 prevents the liquid 12 in the handle body 10 from flowing out of a central hole 36, which is used for maintaining pressure equilibrium in the handle body 10, of the plug 30 at this time.

The covering 40 is used to cover the stem 200 of the head unit 20, the plug 30, and the open end portion 14 of the handle body 10. The covering 40 includes complementary first and second cover parts 41, 42. Each of the cover parts 41, 42 has a smooth outer face 43 and an inner face that is formed with a stem receiving groove 44, a flange receiving groove 45 and a plug engaging groove 46. The inner face of each of the cover parts 41, 42 is further formed with a press projection 47 at the flange receiving groove 45, and a retaining projection 48 at the plug engaging groove 46. As shown in FIG. 2, when the cover parts 41, 42 are installed on the assembly of the head unit 20, the plug 30 and the handle body 10, the stem 200 of the head unit 20 is disposed in the stem receiving grooves 44 of the cover parts 41, 42, the radial flange 21 of the head unit 20 is disposed in the flange receiving grooves 45 and is held in place by the press projections 47, and the first end portion 34 of the plug 30 has a peripheral section which extends into the plug engaging grooves 46. The retaining projection 48 extends into a groove formed between the first end portion 34 of the plug 30 and the end face 140 of the open end portion 14 of the handle body 10, and abuts tightly against the intermediate portion 33 of the plug 30. Thus, the covering 40 does not only enhance the appearance of the eating utensil but can also prevent removal of the head unit 20 from the plug 30.

Figure 3:
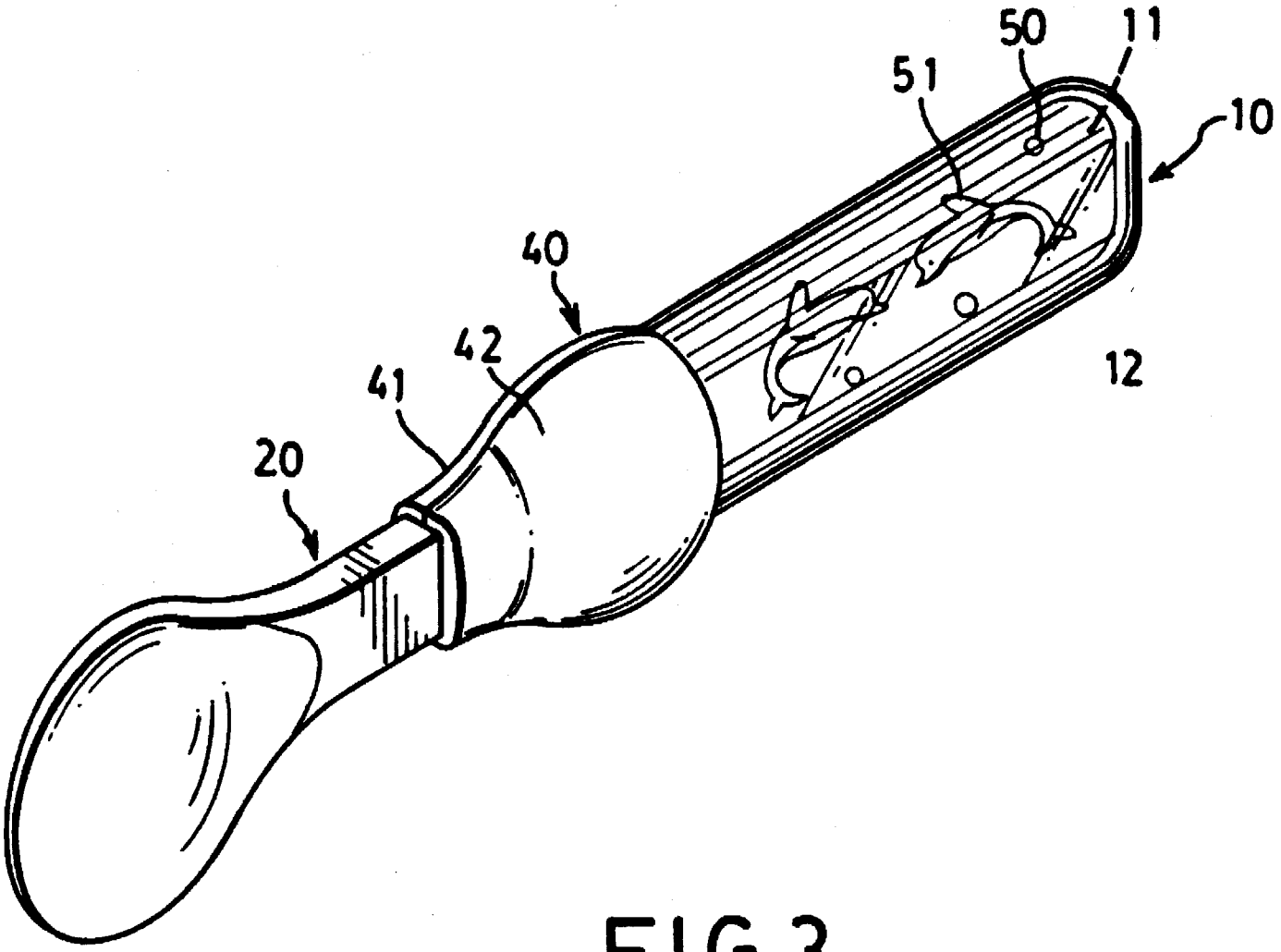
FIG. 3 is a perspective view illustrating assembly of the preferred embodiment.

As shown in FIGS. 2 and 3, float bodies 50 may be disposed in the handle body 10 so that the former floats in the liquid 12 when the eating utensil of the present invention is in use. In this embodiment, the float bodies 50 may include cartoon characters, such as dolphins 51. Movement of the float bodies 50 in the liquid 12 can provide a visual amusing effect to attract the interest of the user when the eating utensil is in use. In addition, the float bodies 50 may be in the form of printed trademarks for advertising purposes.

The eating utensil of the disclosed embodiment is configured as a spoon, although other known eating utensils, such as forks and knives, are also included within the scope of the present invention. Different eating utensils may be fabricated by simply installing different head units on the handle unit.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An eating utensil, comprising:

a head unit having a stem with a distal end portion that is formed with a radial flange and an axial insert projection;

a handle unit including: a handle body formed as an elongated hollow transparent body which confines a receiving space for receiving liquid therein and which has a closed end portion and an open end portion; and a plug having a first end portion formed with an axial insert hole and a second end portion inserted fittingly into said open end portion of said handle body, said insert protection of said head unit extending fittingly into said insert hole; and a covering for covering said stem of said head unit, said plug, and said open end portion of said handle body, said covering including complementary first and second cover parts, each of said cover parts having a smooth outer face and an inner face that is formed with a stem receiving groove, a flange receiving groove and a plug engaging groove, said stem of said head unit being disposed in said stem receiving grooves of said cover parts, said radial flange of said head unit being disposed in said flange receiving grooves of said cover parts, and said first end portion of said plug having a peripheral section which extends into said plug engaging grooves of said cover parts.

2. The eating utensil as claimed in claim 1, wherein said inner face of each of said cover parts is further formed with a press projection at said flange receiving groove, said radial flange of said head unit being held in said stem engaging grooves by said press projections of said cover parts.

3. The eating utensil as claimed in claim 1, wherein:

said plug further has an intermediate portion which extends axially from said first end portion and which is narrower than said first end portion, said second end portion extending axially from said intermediate portion and being narrower than said intermediate portion; and said inner face of each of said cover parts is further formed with a retaining projection at said plug engaging groove, said retaining projection extending between said first end portion of said plug and said open end portion of said handle body.

4. The eating utensil as claimed in claim 1, wherein said handle body has at least one float body disposed therein.

* * * * *

UNITED STATES PATENT AND TRADEMARK OFFICE

CERTIFICATE OF CORRECTION

PATENT NO. : 5,669,143

DATED : September 23, 1997

INVENTOR(S) : Paul Wu

It is certified that error appears in the above-indentified patent and that said Letters Patent is hereby corrected as shown below:

Column 3, line 27, Claim 1, "protection" should be --projection--.

Signed and Sealed this

Ninth Day of December, 1997

*Attest:*

*Attesting Officer*

BRUCE LEHMAN

*Commissioner of Patents and Trademarks*